US007287329B2

(12) United States Patent
Cornacchio

(10) Patent No.: US 7,287,329 B2
(45) Date of Patent: Oct. 30, 2007

(54) SHEETROCK PANEL CUTTING DEVICE

(76) Inventor: Michael Cornacchio, 2027 Jones Ave., Wantagh, NY (US) 11793

( * ) Notice: Subject to any disclaimer, the term of this patent is extended or adjusted under 35 U.S.C. 154(b) by 0 days.

(21) Appl. No.: 10/443,687

(22) Filed: May 21, 2003

(65) Prior Publication Data

US 2004/0231171 A1 Nov. 25, 2004

(51) Int. Cl.
*B26B 29/00* (2006.01)

(52) U.S. Cl. ..... 30/282; 30/286; 30/289; 30/294; 7/163; 7/164

(58) Field of Classification Search ..... 30/282, 30/286, 288, 289, 290, 294, 389, 329; 7/163, 7/164, 119; 33/770, 760, 768, 668, 759, 33/42

See application file for complete search history.

(56) References Cited

U.S. PATENT DOCUMENTS

| | | | | |
|---|---|---|---|---|
| 1,029,767 | A | 6/1912 | Remington | |
| 2,591,333 | A | 4/1952 | Bellmer | |
| 2,818,644 | A | 1/1958 | Crawford | |
| 2,952,025 | A | 9/1960 | Johnson | |
| 3,068,569 | A | 12/1962 | Campbell, Jr. | |
| 3,611,576 | A | 10/1971 | Quenot | |
| 4,255,856 | A | 3/1981 | Mackie | |
| 4,903,409 | A | 2/1990 | Kaplan et al. | |
| 4,949,462 | A | 8/1990 | Spencer | |
| 4,976,037 | A | 12/1990 | Hines | |
| 4,993,093 | A | 2/1991 | Goldwitz | |
| 5,035,054 | A | 7/1991 | Ellenberger | |
| 5,048,189 | A | 9/1991 | Aurness et al. | |
| 5,197,195 | A * | 3/1993 | Aikens | 30/293 |
| 5,265,342 | A * | 11/1993 | Lang, Jr. | 30/294 |
| 5,289,637 | A | 3/1994 | Coffey | |
| 5,295,308 | A | 3/1994 | Stevens et al. | |
| 5,349,760 | A | 9/1994 | DeVito | |
| 5,379,524 | A | 1/1995 | Dawson | |
| 5,430,952 | A | 7/1995 | Betts | |
| 5,542,184 | A | 8/1996 | Beard | |
| 5,842,284 | A | 12/1998 | Goldman | |
| 5,966,820 | A | 10/1999 | Cornacchio et al. | |
| 5,979,063 | A | 11/1999 | Pritz | |
| 6,298,562 | B1 * | 10/2001 | Duquette | 30/294 |
| 6,334,259 | B1 | 1/2002 | Harvey | |
| 6,367,154 | B2 | 4/2002 | Degabli | |
| 6,467,174 | B1 | 10/2002 | Kotori | |
| 6,694,622 | B2 * | 2/2004 | Kim | 30/293 |

OTHER PUBLICATIONS

International Search Report dated Jan. 30, 2004 issued in a counterpart application, namely, Appln. No. PCT/US03/29305.

* cited by examiner

*Primary Examiner*—Boyer D. Ashley
*Assistant Examiner*—Jason Prone
(74) *Attorney, Agent, or Firm*—The Farrell Law Firm, P.C.

(57) ABSTRACT

A device for cutting a sheet rock panel. A base plate has a through slot that receives a blade of a conventional utility knife and a free end right angle metal end clip of conventional tape ruler and a blind slot that receives the conventional tape ruler. A clamping plate is displaceably attached to the base plate and clamps the conventional tape ruler between itself and the base plate. The clamping plate has a center portion that is circular-shaped and a portion that has a concave upper surface and a convex lower surface that clamps the conventional tape ruler in the concave blind slot in the base plate.

14 Claims, 2 Drawing Sheets

SHEETROCK PANEL CUTTING DEVICE

BACKGROUND OF THE INVENTION

1. Field of the Invention

The present invention relates to a cutting tool. More particularly, the present invention relates to a Sheetrock® (hereinafter refer to as sheetrock or sheet rock) panel cutting tool.

2. Description of the Prior Art

Rectangular panels of sheet rock material are universally used to form walls, ceilings, and other utilitarian and decorative structures and surfaces that are encountered in all phases of the building construction trade.

Typically, sheet rock consists of gypsum material formed into a sheet of standard stock thickness. The gypsum sheet is bonded on both sides with a heavy paper material which greatly enhances the overall strength and integrity of the sheet rock panel and which allows the panel to be cut into smaller panels while still retaining its structural integrity.

Cutting the sheet rock material into custom size panels is typically accomplished by first measuring the space into which the proposed panel will be installed and then transferring these measurements to the sheet rock surface using a pencil and a ruler or other functionally straightedge devices. Finally, a utility knife is used to cut through the paper covering on the previously scribed marking, but usually only on one side of the panel. After the knife cut is made, the workman positions his hands and forearms on the panel and exerts a bending force on both sides of the panel in proximity to the cut line.

As a result of the brittle nature of the gypsum core material, when sufficient bending force is applied, the gypsum material spontaneously fractures evenly along the entire length of the cut line. Since the fractured section of the sheet rock is still attached to the parent sheet at some arbitrary angle by the paper covering on the opposite side of the sheet rock panel, the workman proceeds to the opposite side and separates the cut panel from the parent sheet by using the same utility knife to cut the paper covering along the creased line caused by the previous act of bending and splitting the panel. Once the paper covering is cut, the desired panel is now free from the parent panel and ready for installation.

Numerous innovations and devices for combination measuring and cutting tools have been provided in the prior art. Even though these innovations and devices may be suitable for the specific individual purposes to which they address, however, they differ from the present invention.

SUMMARY OF THE INVENTION

Accordingly, an object of the present invention is to provide a sheet rock panel cutting device that avoids the disadvantages of the prior art.

Another object of the present invention is to provide a sheet rock panel cutting device that is simple and inexpensive to manufacture.

Still another object of the present invention is to provide a sheet rock panel cutting device that is simple to use.

Briefly stated, yet another object of the present invention is to provide a device for cutting a sheet rock panel. A base plate has a through slot that receives a blade of a conventional utility knife and a free end right angle metal end clip of a conventional tape ruler and a blind slot that receives the conventional tape ruler. A clamping plate is displaceably attached to the base plate and clamps the conventional tape ruler between itself and the base plate. The clamping plate has a center portion that is circular-shaped and a portion that has a concave upper surface and a convex lower surface that clamps the conventional tape ruler in the concave blind slot in the base plate.

When determining the size of a panel required for a given wall or ceiling location, it is necessary to first measure the opening which needs to be filled with the new sheet rock panel. This is facilitated by measuring the opening with a tape measure, then transferring these measurements to the parent sheet rock panel for eventual cutting of the required panel size.

Rather than using a separate tape measure to make and transfer this measurement, a device is provided that is attachable to the end of a conventional metal tape ruler and uses that same tape measure to not only measure the opening but to also guide the cut of the sheet rock while accomplishing both these functions without having to remove the tape measure from the present invention.

The present invention allows the insertion of a conventional utility knife into a preformed slot therein which causes the blade of the knife to be aligned juxtaposed to the right angle clip of the tape ruler. The blade protrudes through a baseplate of the present invention and is directly positioned against the ruler right angle end clip. The device is used to cut a rectangular panel of sheet rock of predetermined size from a full sheet by holding the utility knife, which is replaceably engaged in the present invention, against the sheet rock paper surface with one hand while grasping the metal tape ruler surface, at a previously measured position on the tape, with the other hand against the edge of the sheet rock panel. Once positioned, the workman draws both hands in parallel motion across sheet rock with one hand and thereby causing the blade of the knife to cut through the sheet rock paper covering, while maintaining contact with the measured position of the ruler against the edge of the sheet rock panel with the remaining hand. This action causes a cut line to be formed across the entire width of the sheet rock panel paper surface, which is the first step in the formation of a sheet rock panel of desired size.

The novel features which are considered characteristic of the present invention are set forth in the appended claims. The invention itself, however, both as to its construction and its method of operation, together with additional objects and advantages thereof, will be best understood from the following description of the specific embodiment when read and understood in connection with the accompanying drawings.

DETAILED DESCRIPTION OF THE INVENTION

Figure 1:
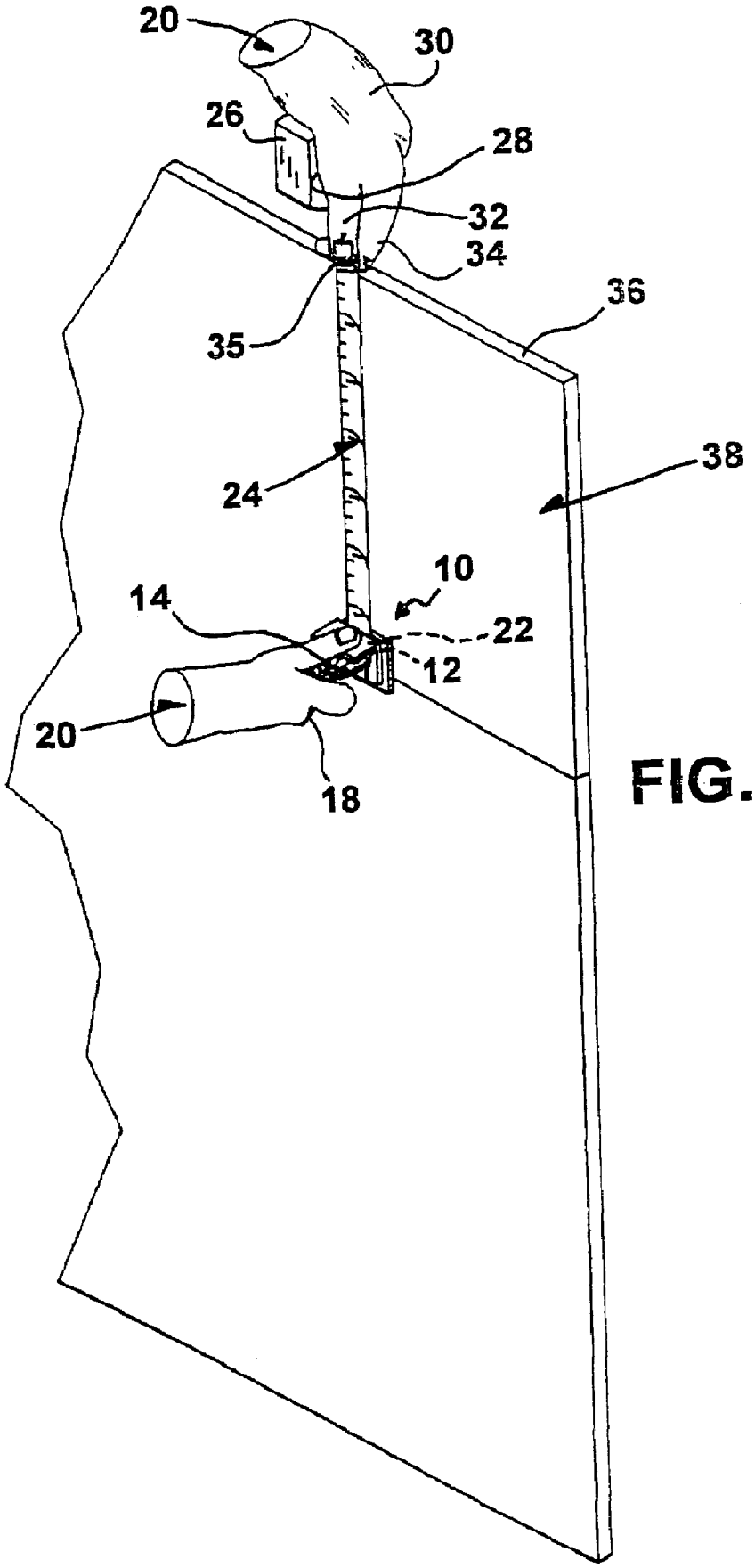
FIG. 1 is a perspective view of the present invention utilizing a conventional tape ruler and a conventional utility knife to cut a sheet rock panel to a desired size.

Referring now to the figures in which like numerals indicate like parts, and particularly to FIG. 1, the sheet rock panel cutting device of the present invention is shown generally at 10 interaction with a blade 12 of a conventional utility knife 14 that is replaceably insertable in the sheetrock panel cutting device 10. The sheet rock panel cutting device 10 further interacts with a free end right angle metal end clip 22 of a conventional metal tape ruler 24 that is replaceably engagable with the sheet rock panel cutting device 10 and which is typically fastened to the conventional metal tape ruler 24 by a pair of rivets (see FIG. 2A). A ruler casing 26 of the conventional metal taper ruler 24 is held in palm 28 of a hand 30 of the user 20, with thumb 32 and an index finger 34 gripping the conventional metal tape ruler 24 at a desired ruler measurement 35 of the conventional metal tape ruler 24, and is maintained thereat by the index finger 34 abutting against an edge 36 of a sheet rock panel 38.

The configuration of the sheet rock panel cutting device 10 and its interaction with the conventional utility knife 14 and the conventional metal tape ruler 24 can best be seen in FIGS. 2, 2A, 2B, and 3, and as such, will be discussed with reference thereto.

The sheet rock panel cutting device 10 includes a base plate 40 that is generally square-shaped and has a front edge 42, and inner edge 44 which is perpendicular to the front edge 42 by virtue of its generally square design, and imaginary longitudinal line 46, and imaginary lateral line 48, and upper surface 50 that is flat, a rear edge 52 that is displaced behind, and parallel to, the front edge 42 and which is perpendicular to the inner edge 44 by virtue of its generally square-shaped design, and outer edge 54 which is displaced from, and parallel to, the inner edge 44 by virtue of its generally square-shaped design, and a lower surface 56 which is flat and displaced below, and parallel to, the upper surface 50. The imaginary lateral line 48 is positioned midway between the front edge 42 and the rear edge 52.

The base plate 40 further has a through slot 58 that is generally rectangular-shaped, continuous, and extends therethrough from the upper surface 50 to the lower surface 56. The through slot 58 extends from short of the front edge 42 and extends continuously therefrom, and collinearly along, the imaginary longitudinal line 46, to short of the rear edge 42, perpendicularly to the imaginary lateral line 48. The upper surface 50 has a blind slot 60 that is generally semi-cylindrically-shaped, continuous, shallow, and opens into both the inner edge 44 and the through slot 58, while extending continuously between the inner edge 44 and the through slot 58, and collinearly along the imaginary lateral line 48. The slot 60 is preferably machined or cast into the base plate 40.

The base plate 40 further has a pair of through bores 62 that are spaced-apart and extend therethrough from the upper surface 50 to the lower surface 56. Each through bore of the pair of through bores 62 is disposed between the inner edge 44 and the imaginary longitudinal line 46, and on opposite sides of the imaginary lateral line 48. The base plate 40 further has a through bore 63 that extends therethrough from the upper surface 50 to the lower surface 56.

The sheet rock panel cutting device 10 further includes a clamping plate 64 that is replaceably mounted to the base plate 40. The clamping plate 64 has a gripping portion 66 that is vertically-oriented, with a lower edge 68 thereof that is similar length as, and slightly inward of, the inner edge 44. The gripping portion 66 of the clamping plate 64 has a center portion 69 that is circular-shaped and has an inner surface 71 that is concave and an outer surface 73 that is generally flat, and a pair of wing portions 74 that extend from opposite sides of the center portion 69, respectively. The lower edge 68 of the gripping portion 66 of the clamping plate 64 has a pair of blind bores 77 therein that are threaded and disposed in the pair of wing portions 74.

The clamping plate 64 further has a portion 70 that is concave shaped, horizontally-oriented, and extends perpendicularly outwardly from inner and outer sides A and B of the lower portion of the center portion 69 that are parallel to the inner edge 44 and the outer edge 54 of the base plate 40, to a distance slightly prior to the through slot 58 on one side and slightly prior to the inner edge 44 of the base plate 40 on the other side. The portion 70 has an upper surface that is concave and a lower surface that is convex and positioned below, and parallel to, the upper surface. The lower surface is in general abutment in the blind slot 60 in the base plate 40.

Figures 2, 2A, 2B, 3:
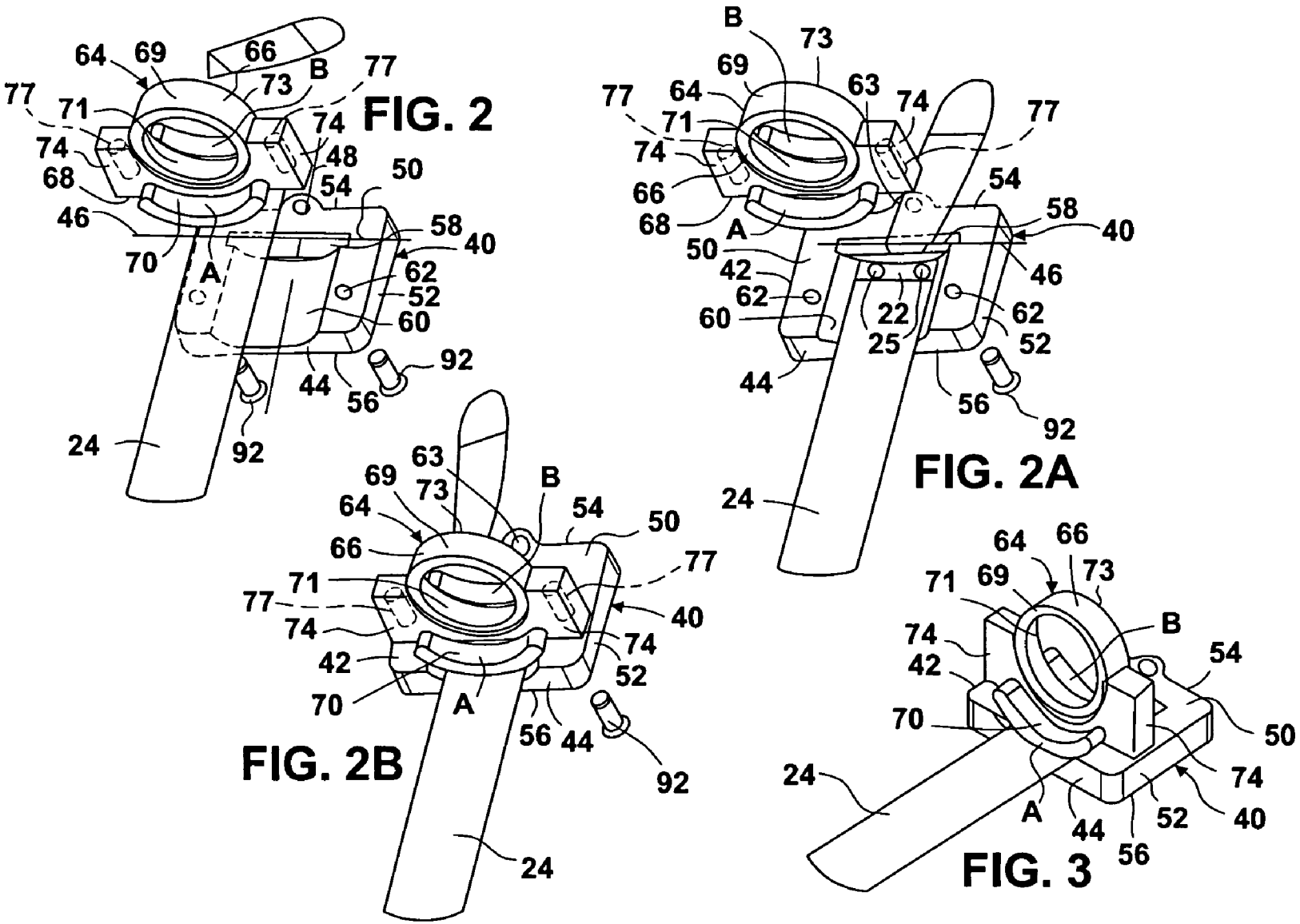
FIG. 2 is a fully exploded perspective view of the present invention shown in FIG. 1 illustrating the interaction thereof with the conventional tape ruler and the conventional utility knife.
FIG. 2A is a partially exploded perspective view of the present invention shown in FIG. 1 illustrating the interaction thereof with the conventional tape ruler and the conventional utility knife.
FIG. 2B is another partially exploded perspective view of the present invention shown in FIG. 1 illustrating the interaction thereof with the conventional tape ruler and the conventional utility knife.
FIG. 3 is an assembled perspective view of the present invention shown in FIG. 1 illustration the interaction thereof with the conventional tape ruler and the conventional utility knife.

The sheet rock panel cutting device 10 further includes a pair of machine screws 92. Each screw of the pair of machine screws 92 passes freely through the pair of through bores 62 in the base plate 40, respectively, and theradably engages in the pair of blind bores 77 in the clamping plate 64, respectively, to secure the device as shown in FIG. 3.

The general steps for utilizing the sheetrock panel cutting device 10 of the present invention are as follows: As shown in FIGS. 2-3, the pair of machine screws 92 are loosened and the clamping plate 64 is upwardly displaced from the base plate 40. The convex side of the conventional metal tape ruler 24 is positioned collinearly in the blind slot 60, with the end lip of the free end right angle metal end clip 22 inserted into the through slot 58, while the blind slot 60 forms a refuge for the pair of rivets 25 that may protrude slightly from the convex side of the conventional metal tape ruler 24. A slight pulling force is exerted on the conventional metal tape ruler 24, in a direction away from the through slot 58 in the base plate 40, until the inside surface of the end lip of the free end right angle metal end clip 22 contacts the surface of the through slot 58 nearest the pair of through bores 62 in the base plate 40, sufficient in size to accommodate the subsequent insertion of the blade 12 into the through slot 58. The pair of machine screws 92 are then tightened until the lower surface of the portion 70 comes into pressure contact with the conventional metal tape ruler 24 thereby clamping the conventional metal tape ruler 24 between the base plate 40 and the clamping plate 64.

The sheet rock panel cutting device 10 is held in one hand 18 gripping the gripping portion 66, while the ruler casing 26 is held in the palm 28 of the other hand. The metal tape ruler 24 is positioned over the opening in the wall or ceiling to be covered with the conventional sheet rock panel 38 and the outer edge 54 is held coincident with one edge of the opening. The metal tape ruler 24 is extended from the ruler casing 26 a sufficient amount to reach the opposite parallel edge of the opening to be covered to determine the size to be cut.

Once the size is determined, the metal tape ruler 24 is held between the thumb 32 and the index finger 34, at the required width of the sheet rock panel 38 that will be cut to cover the opening. The index finger 34 is held against the edge 36 of the sheet rock panel so as to form a temporary mechanical stop. It is to be understood, however, that some conventional metal tape rulers 24 are also equipped with a built-in mechanical stop device which, depending upon the effectiveness of the mechanical stop mechanism, can be held against the edge 36. With the mechanical stop mechanism engaged, the edge of the ruler casing 26 would abut against the panel edge 36 of the sheet rock panel. The sheet rock panel cutting device 10 is placed across the piece of sheet rock panel to be cut, and the blade 12 is inserted into the through slot 58 a sufficient amount to cause the blade 12 to protrude through the through slot 58, and past the lower surface 56.

Pressure is then exerted on the utility knife 14 to cause the blade 12 to enter the sheet rock panel. Both hands are then drawn simultaneously, in parallel motion, across the surface of the sheet rock panel so as to cause the blade 12 to produce a cut mark parallel to the edge 36 of the sheet rock panel. It is to be understood that in sheet rock work it is not critical that the final cut dimensions must exactly match the dimensions for the opening which is to be covered. Such dimensional discrepancies are easily compensated for through the skilled use of sheetrock tape and joint compound materials common to the installation of sheetrock material.

While the invention has been illustrated and described as embodied in a sheetrock panel cutting device, it is not limited to the details shown, since it will be understood that various omissions, modifications, substitutions and changes in the form and details of the device illustrated and its operation can be made by those skilled in the art without departing in any way form the spirit of the present invention.

What is claimed is:

1. A device for guiding a knife configured to cut an item, comprising:

a tape having first and second parallel sides extending between opposite ends of the tape, the opposite ends being displaceable relative to one another to establish a desired length of the tape;

a base plate configured to removably receive a blade of the knife, the base plate having a pair of through bores and being juxtaposed with the first side of the tape along one of the opposite ends thereof; and a clamping plate having a side portion with a central portion and inner and outer sides extending perpendicularly outwardly from inner and outer sides of the central portion, the side portion extending outwards from a bottom portion of the clamping plate toward an inner edge of the base plate, the clamping plate being juxtaposed with the second side of the tape and detachably coupled to the base plate to clamp the one end of the tape between the clamping and base plates, whereas, upon establishing the desired length of the tape, the tape is displaceable relative to the item so that the blade cuts a portion of the item having a dimension corresponding to the desired length of the tape, wherein the clamping plate has a pair of blind bores disposed at a bottom surface and extending into the clamping plate, the blind bores being aligned with the pair of through bores of the base plate.

2. The device of claim 1, wherein the base plate has a blind slot and an outer edge, wherein the inner and outer edges extend transversely to a length of the tape, and wherein the blind slot extends outwards from the inner edge and is configured to removably receive the one end of the tape.

3. The device of claim 2, wherein the blind slot terminates in a through slot of the base plate configured to receive the blade of the knife and located between the inner and outer edges of the base plate, the through slot being configured to receive a free end of an end clip, which has a body extending transversely to the free end between the second side of the tape and the clamping plate towards the outer edge of the base plate, the free end of the end clip extends into the through slot and terminates at a distance from the first side of the tape to provide a support for the blade of the knife upon insertion thereof through the through slot.

4. The device of claim 2, wherein the blind slot has a concave surface extending outwards from the clamping plate and complementary to the second side of the tape.

5. The device of claim 2, wherein the pair of through bores are spaced from one another and flank the blind slot, the clamping plate being juxtaposed with and extending complementary to a concave surface of the blind slot so that the one end of the tape extends between and in contact with the bottom surface of the blind slot and the clamping plate.

6. The device of claim 5, wherein the blind bores and through bores are each configured to receive a respective screw extending through the aligned blind and through bores to detachably couple the clamping and base plates.

7. The device of claim 6, wherein the the central portion and inner and outer sides each have a respective convex bottom surface abutting the concave surface of the blind slot.

8. The device of claim 7, wherein the central portion has a circular body and two wing portions terminating flush with a respective one of opposite flanks of the base plate, which define therebetween a width of the base plate, each of the two wing portions being provided with a respective one of the blind bores.

9. The device of claim 7, wherein the central and side portions of the clamping plate each have a respective concave surface located so that the concave surface of the central portion extends transversely to the concave portions of the side portions preventing the finger of the user, rested upon the concave surface of the central portion, from slipping.

10. A device for cutting a sheet rock panel, comprising:

a tape ruler provided with a tape extending between a free end and a fixed end of the tape, the free and fixed ends being displaceable relative to one another at a distance corresponding to a desired dimension of a portion of the sheet rock panel to be cut;

a base plate having a pair of through bores and being mounted on the free end of the tape and configured to receive a blade;

a clamping plate having a side portion with a central portion and inner and outer sides extending perpendicularly outwardly from inner and outer sides of the central portion; and a gripping element coupled to the tape and having a concave surface configured to support a finger of a user during cutting of the sheet rock panel with the blade, whereas, as the tape ruler is displaced relative to the sheet rock panel, the blade uniformly cuts the portion of the sheet rock panel having the desired dimensions, wherein the clamping plate has a pair of blind bores disposed at a bottom surface and extending into the clamping plate, the blind bores being aligned with the pair of through bores of the base plate.

11. The device of claim 10, wherein the clamping plate is juxtaposed with the base plate so that the tape is engaged between the base and clamping plates, the clamping plate being coupled to the gripping element.

12. The device of claim 11, wherein the clamping plate has a pair of wing portions extending between the side portions so that the side and wing portions surround the gripping element, the side portions each having a respective outer concave surface extending transversely to the concave surface of the gripping element to abut and prevent displacement of the finger of a user resting upon the gripping element.

13. The device of claim 12, wherein the gripping element and the side and wing portions are coupled to form a one-piece body.

14. The device of claim 11, wherein the base plate has a blind slot terminating at a through slot configured to receive the blade of the knife and located between inner and outer spaced apart edges of the base plate, the through slot being configured to receive a free end of an end clip, which has a body extending transversely to the free end and between the tape and the clamping plate and coupled to the tape, the free end of the end clip extends into the through slot and terminating at a distance from the tape to provide a support for the blade upon displacement thereof through the through slot.

* * * * *